US011279898B2

(12) United States Patent
Sakanoue et al.

(10) Patent No.: US 11,279,898 B2
(45) Date of Patent: Mar. 22, 2022

(54) LUBRICATING OIL COMPOSITION FOR SHOCK ABSORBER

(71) Applicant: Idemitsu Kosan Co., Ltd., Chiyoda-ku (JP)

(72) Inventors: Shuichi Sakanoue, Chiba (JP); Tatsuya Hamachi, Chiba (JP)

(73) Assignee: Idemitsu Kosan Co., Ltd., Chiyoda-ku (JP)

( * ) Notice: Subject to any disclaimer, the term of this patent is extended or adjusted under 35 U.S.C. 154(b) by 0 days.

(21) Appl. No.: 16/630,592

(22) PCT Filed: Nov. 7, 2018

(86) PCT No.: PCT/JP2018/041267
§ 371 (c)(1),
(2) Date: Jan. 13, 2020

(87) PCT Pub. No.: WO2019/098098
PCT Pub. Date: May 23, 2019

(65) Prior Publication Data

US 2020/0172824 A1 Jun. 4, 2020

(30) Foreign Application Priority Data

Nov. 14, 2017 (JP) ..... JP2017-218798

(51) Int. Cl.

| | |
|---|---|
| ***C10M 141/10*** | (2006.01) |
| ***C10M 101/02*** | (2006.01) |
| ***C10M 127/04*** | (2006.01) |
| ***C10M 137/02*** | (2006.01) |
| ***C10M 169/04*** | (2006.01) |
| ***C10N 30/02*** | (2006.01) |
| ***C10N 30/10*** | (2006.01) |
| ***C10N 30/12*** | (2006.01) |

(52) U.S. Cl.
CPC ..... *C10M 141/10* (2013.01); *C10M 101/02* (2013.01); *C10M 127/04* (2013.01); *C10M 137/02* (2013.01); *C10M 169/04* (2013.01); *C10M 2203/06* (2013.01); *C10M 2223/049* (2013.01); *C10M 2290/02* (2013.01); *C10N 2030/02* (2013.01); *C10N 2030/10* (2013.01); *C10N 2030/12* (2013.01)

(58) Field of Classification Search
CPC ..... C10M 101/02; C10M 127/04; C10M 141/10; C10M 169/04; C10M 2203/06; C10M 2203/1006; C10M 2209/084; C10M 2223/049; C10M 2290/02; C10M 137/02; C10N 2020/02; C10N 2020/04; C10N 2030/02; C10N 2030/04; C10N 2030/06; C10N 2030/10; C10N 2030/12; C10N 2040/08; C10N 2040/42
See application file for complete search history.

(56) References Cited

U.S. PATENT DOCUMENTS

| | | | | |
|---|---|---|---|---|
| 3,431,094 | A * | 3/1969 | Leas | C10G 25/00 585/14 |
| 6,749,772 | B2 * | 6/2004 | Zumdome | C10M 105/12 106/272 |
| 2003/0144159 | A1 * | 7/2003 | Akiyama | C10M 171/007 508/462 |
| 2009/0005274 | A1 | 1/2009 | Swartele et al. | |
| 2015/0065407 | A1 | 3/2015 | Matsumoto et al. | |
| 2015/0240182 | A1 * | 8/2015 | Sakanoue | C10M 141/10 508/287 |

FOREIGN PATENT DOCUMENTS

| | | | |
|---|---|---|---|
| JP | 5-255682 | A | 10/1993 |
| JP | 2010-531922 | A | 9/2010 |
| JP | 2013-209590 | A | 10/2013 |

OTHER PUBLICATIONS

International Search Report dated Dec. 18, 2018 in PCT/JP2018/041267 filed on Nov. 7, 2018, 1 page.

* cited by examiner

*Primary Examiner* — Latosha Hines
(74) *Attorney, Agent, or Firm* — Oblon, McClelland, Maier & Neustadt, L.L.P.

(57) ABSTRACT

Provided is a lubricating oil composition for a shock absorber, the lubricating oil composition being capable of emitting fluorescence by ultraviolet irradiation while ensuring thermal stability and abrasion resistance. This lubricating oil composition for a shock absorber contains, as components: (A) a base oil; (B) a hydrocarbon compound having a stilbene structure; and (C) a phosphite ester.

8 Claims, No Drawings

LUBRICATING OIL COMPOSITION FOR SHOCK ABSORBER

TECHNICAL FIELD

The present invention relates to a lubricating oil composition for shock absorbers, which is capable of emitting fluorescence upon ultraviolet irradiation.

BACKGROUND ART

Shock absorbers are used after being filled with a lubricating oil composition for shock absorbers. The aim is to cause an attenuating force that attenuates vibration in the car body, to optimize the friction properties of sliding parts to thereby control the riding comfort of automobiles, and to reduce frictional wear in sliding parts to thereby ensure the durability of shock absorbers.

To reduce frictional wear in sliding parts, a lubricating oil composition for shock absorbers is generally configured to comprise additives such as antiwear agents, as exemplified by phosphate esters, phosphite esters, etc. Among them, phosphite esters give good wear resistance and are included into a lubricating oil composition for shock absorbers in an attempt to improve the protection of sliding parts from frictional wear.

A shock absorber is a non-replaceable automobile component. In some rare cases, however, oil leakage to the outside will occur mainly from the sliding part of an oil seal/piston rod. To easily find out leakage when it has occurred, techniques using a fluorescent agent may be used for leakage detection. In more detail, shock absorber oil includes a fluorescent agent, and ultraviolet light is irradiated to confirm the presence or absence of fluorescence emission, thereby detecting the presence or absence of leakage of the shock absorber oil. This allows easy discrimination of whether the oil filled into the shock absorber is leaking to the outside or another oil is merely adhered to the shock absorber due to any other external factor. As typical fluorescent agents for use in shock absorber oil, fluorescein-based compounds are known.

In addition to this, hydrocarbon compounds such as stilbene compounds are also known as fluorescent agents to be incorporated into refrigeration oil or the like (Patent Document 1). However, there has been no case where such a hydrocarbon-based fluorescent agent is used in shock absorber oil.

PRIOR ART DOCUMENTS

Patent Documents

Patent Document 1: JP 2013-209590 A

SUMMARY OF THE INVENTION

Problem to be Solved by the Invention

However, when a fluorescent agent is included together with a phosphite ester serving as an antiwear agent, the thermal stability of shock absorber oil will be reduced in some cases.

The problem of the present invention is to provide a lubricating oil composition for shock absorbers, which is capable of emitting fluorescence upon ultraviolet irradiation while ensuring thermal stability and wear resistance.

Means to Solve the Problem

As a result of extensive and intensive efforts made to solve the problem stated above, the inventors of the present invention have found that the above problem can be solved when a hydrocarbon compound having a stilbene structure is included as a fluorescent agent together with a phosphite ester. This finding led to the completion of the present invention.

Namely, in one embodiment of the present invention, there is provided a lubricating oil composition for shock absorbers, which contains the following components: (A) a base oil; (B) a hydrocarbon compound having a stilbene structure; and (C) a phosphite ester.

Moreover, in another embodiment of the present invention, there is provided a process for preparing the above lubricating oil composition for shock absorbers.

Effects of the Invention

The present invention enables the provision of a lubricating oil composition for shock absorbers, which is capable of emitting fluorescence upon ultraviolet irradiation while ensuring thermal stability and wear resistance.

DESCRIPTION OF EMBODIMENTS

The embodiments of the present invention will be further described in more detail below. It should be noted that the present invention is not limited to the embodiments illustrated below and may be carried out with appropriate modifications without departing from the spirit of the present invention.

One embodiment of the present invention is directed to a lubricating oil composition for shock absorbers (hereinafter also referred to as the "composition" or the "lubricating oil composition"), which contains the following components: (A) a base oil; (B) a hydrocarbon compound having a stilbene structure; and (C) a phosphite ester. The composition according to the embodiment optionally further contains (D) other additives. The individual components contained in the composition according to the embodiment will be explained sequentially below.

[Component (A): Base Oil]

The base oil to be used is not limited in any way, and any oil may be selected as appropriate from among mineral oils and synthetic oils, each being conventionally used as a base oil for lubricating oil.

Examples of mineral oils include those prepared as follows: the reduced crude obtained from crude oil upon atmospheric distillation is distilled under reduced pressure and the resulting lubricating oil fraction is purified by one or more treatments selected from among solvent deasphalting, solvent extraction, hydrocracking, solvent dewaxing, catalytic dewaxing, hydrorefining, etc. Other examples include mineral oils prepared by isomerization of waxes or GTL waxes (gas-to-liquid waxes). Among them, mineral oils treated by hydrorefining or mineral oils prepared by isomerization of GTL waxes are preferred in terms of % $C_P$ (saturate content) and viscosity index described later.

Mineral oils are classified as group I, II or III in the base oil category of the API (American Petroleum Institute), and those classified as group II or III are preferred in terms of reducing sludge generation. Moreover, those classified as group III are more preferred in terms of improved oxidative stability. It should be noted that base oils classified as group I have a saturate content of less than 90%, a sulfur content greater than 0.03%, a viscosity index of 80 or more and less than 120. On the other hand, base oils classified as group II have a saturate content of 90% or more, a sulfur content of 0.03% or less, and a viscosity index of 80 or more and less than 120. Base oils classified as group III have a saturate content of 90% or more, a sulfur content of 0.03% or less, and a viscosity index of 120 or more. It should be noted that the sulfur content is a value measured according to JIS K2541, while the saturate content is a value measured according to ASTM D 3238. Further, the viscosity index is a value measured according to JIS K2283:2000.

These mineral oils may be used alone, or two or more of them may be used in combination.

Examples of synthetic oils include polybutenes; poly-α-olefins such as α-olefin homopolymers, α-olefin copolymers (e.g., ethylene-α-olefin copolymers) and so on; various esters such as polyol esters, dibasic acid esters, phosphate esters and so on; various ethers such as polyphenyl ethers and so on; polyglycols; alkylbenzenes; alkylnaphthalenes, etc. Among these synthetic oils, poly-α-olefins and esters are preferred. These synthetic oils may be used alone, or two or more of them may be used in combination.

Moreover, one or more of the above mineral oils and one or more of the above synthetic oils may be used in combination as a base oil.

In terms of the solubility of additives such as a phosphite ester, mineral oils are preferred for use as a base oil. In one embodiment, the base oil contains a mineral oil(s) as a major component. The phrase "contains—as a major component" is intended to mean that the base oil (100% by mass) contains a mineral oil(s) in an amount of 60% by mass or more, preferably 75% by mass or more, more preferably 80% by mass or more, and particularly preferably 100% by mass (i.e., the base oil consists of a mineral oil(s)). It should be noted that it is preferable to incorporate two or more of the above mineral oils, etc., in terms of low-temperature viscosity properties, flash point and aniline point.

The base oil is a major component of the lubricating oil composition, and the content of the base oil is generally preferably 65% to 97% by mass, more preferably 70% to 95% by mass, and even more preferably 75% to 92% by mass, on the basis of the total mass of the composition.

The viscosity of the base oil is not limited in any way. The kinematic viscosity at 40° C. of the base oil is preferably 3 to 35 $mm^2/s$, more preferably 3 to 30 $mm^2/s$, and even more preferably 3 to 20 $mm^2/s$, in terms of ensuring fluidity at low temperatures.

The kinematic viscosity at 100° C. of the base oil is preferably 1.0 to 20.0 $mm^2/s$, more preferably 1.0 to 15.0 $mm^2/s$, even more preferably 1.0 to 10.0 $mm^2/s$, and still even more preferably 1.0 to 7.0 $mm^2/s$, in terms of ensuring fluidity at low temperatures.

The viscosity index of the base oil is preferably 70 or more, more preferably 80 or more, and even more preferably 90 or more. Such a base oil whose viscosity index is 70 or more shows a small change in its viscosity with temperature. For the reason that the viscosity index of the base oil is within the above range, the lubricating oil composition is more likely to have good viscosity properties.

It should be noted that the values of kinematic viscosity at 40° C., kinematic viscosity at 100° C. and viscosity index are measured according to JIS K2283:2000.

[Component (B): Hydrocarbon Compound Having a Stilbene Structure]

In the lubricating oil composition according to the embodiment, a hydrocarbon compound having a stilbene structure (hereinafter also simply referred to as the "stilbene compound") serves as a fluorescent agent. Except for this stilbene compound, it is difficult to exert thermal resistance which may fulfill the requirements in the lubricating oil composition comprising a phosphite ester compound for use in shock absorbers. The fluorescent agent intended herein refers to a substance capable of emitting fluorescence at a detectable level upon irradiation with ultraviolet light (wavelength: 100 to 400 nm).

The hydrocarbon compound having a stilbene structure refers to a hydrocarbon compound having a 1,2-diphenylethene skeletal structure (stilbene structure unit). The stilbene structure may be in cis- or trans-form. Examples of such a stilbene compound include stilbene, distyrylbenzene, or polystyrylstilbene (e.g., distyrylstilbene). The benzene rings that forms this stilbene, distyrylbenzene or polystyrylstilbene may have one or more hydrocarbon groups attached thereto, each containing 1 to 18 carbon atoms (preferably 1 to 6 carbon atoms, more preferably 1 to 3 carbon atoms). If the benzene rings have a plurality of hydrocarbon groups, they may be identical or different. Moreover, there is also no limitation on the positions at which hydrocarbon groups are attached. Examples of such a hydrocarbon group include an alkyl group containing 1 to 18 carbon atoms, an alkenyl group containing 2 to 18 carbon atoms (which has a double bond at any position), an aryl group containing 6 to 18 carbon atoms, an aralkyl group containing 7 to 18 carbon atoms, etc. The above alkyl and alkenyl groups may be linear, branched or cyclic. There is no limitation on the number of styryl groups contained in polystyrylstilbene. However, the total number of carbon atoms in the stilbene compound is, for example, 14 to 42, preferably 18 to 32, and more preferably 20 to 28.

In one embodiment, the hydrocarbon compound having a stilbene structure is a compound represented by formula (1) or formula (2) shown below.

[Formula 1]

(1)

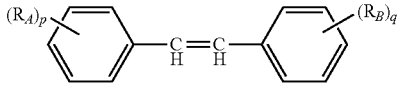

(2)

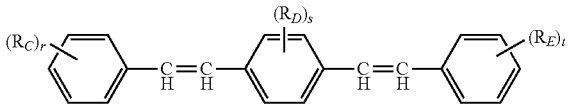

In the above formulae (1) and (2), $R_A$ to $R_E$ each independently represent a hydrocarbon group containing 1 to 18 carbon atoms. In terms of the solubility of additives, examples include an alkyl group containing 1 to 18 carbon atoms (preferably 1 to 6 carbon atoms, more preferably 1 to 3 carbon atoms), an alkenyl group containing 2 to 18 carbon atoms (preferably 2 to 6 carbon atoms, more preferably 2 or 3 carbon atoms) (which has a double bond at any position), an aryl group containing 6 to 18 carbon atoms (preferably 6 to 12 carbon atoms, more preferably 6 to 8 carbon atoms), an aralkyl group containing 7 to 18 carbon atoms (preferably 7 to 12 carbon atoms, more preferably 7 to 8 carbon atoms), etc.

In the above formulae (1) and (2), p, q, r and t are each independently an integer of 0 to 5, preferably an integer of 0 to 4, and more preferably an integer of 1 or 2.

In the above formulae (1) and (2), s is an integer of 0 to 4, preferably an integer of 0 to 2, and more preferably an integer of 0 or 1.

If p to r are each an integer of 1 or greater, $R_A$ to $R_E$ may be mutually identical or different.

Examples of an alkyl group containing 1 to 18 carbon atoms include a methyl group, an ethyl group, a propyl group, an isopropyl group, a n-butyl group, an isobutyl group, a sec-butyl group, a tert-butyl group, various pentyl groups, various hexyl groups, a cyclopentyl group, a cyclohexyl group and so on. It should be noted that the expression "various" used here means including not only the linear form but also structural isomers thereof, i.e., all possible branched forms. The same also applies hereinafter.

Examples of an alkenyl group containing 2 to 18 carbon atoms include a vinyl group, various propenyl groups, various butenyl groups, various pentenyl groups, various hexenyl groups, a cyclopentenyl group, a cyclohexenyl group and so on.

Examples of an aryl group containing 6 to 18 carbon atoms include a phenyl group, a tolyl group, a xylyl group, a naphthyl group and so on.

Examples of an aralkyl group containing 7 to 18 carbon atoms include a benzyl group, a phenethyl group, a naphthylmethyl group, a methylbenzyl group, a methylphenethyl group, a methylnaphthylmethyl group and so on.

Specific examples of the stilbene compound include p-bis(o-methylstyryl)-benzene, styrylbenzene, bis-styrylbiphenyl, 1,4-distyrylbenzene and so on. Among them, p-bis(o-methylstyryl)benzene is preferred in terms of the solubility of additives.

These stilbene compounds may be used alone, or two or more of them may be used in combination.

On the basis of the total mass of the composition, the content of the stilbene compound(s) is preferably 0.001% by mass or more, and more preferably 0.01% by mass or more, in terms of obtaining a sufficient amount of fluorescence upon ultraviolet irradiation, and it is even more preferably 0.02% by mass or more in terms of thermal stability. Alternatively, it is preferably 0.3% by mass or less, more preferably 0.2% by mass or less, and even more preferably 0.1% by mass or less. Even when the stilbene compound(s) is included in an amount greater than the upper limit value, there is no particular improvement in detectability for leakage sites, or rather it is disadvantageous in terms of costs. Moreover, particularly in the case of containing a mineral oil as a base oil, the stilbene compound(s) included in an amount greater than the upper limit value may reduce the solubility of the stilbene compound(s) into the lubricating oil composition. By way of example, the content of the stilbene compound(s) is 0.001% to 0.1% by mass, or 0.01% to 0.09% by mass, or 0.02% to 0.08% by mass.

The term "thermal stability" used herein refers to thermal oxidation resistance at high temperatures and, for example, may be evaluated by measuring the amount of sludge generation at high temperatures, as described in the Example section.

The lubricating oil composition according to the embodiment may contain an additional fluorescent agent other than the hydrocarbon compound having a stilbene structure, as long as the effect of the present invention is not impaired. However, when an additional fluorescent agent (e.g., a fluorescein-based compound) other than the stilbene compound is included together with a phosphite ester, the stability of the lubricating oil composition will be reduced in some cases. Thus, in terms of improved thermal stability, the content of such an additional fluorescent agent other than the hydrocarbon compound having a stilbene structure in the lubricating oil composition according to the embodiment is preferably 0% to 0.004% by mass, more preferably 0% to 0.001% by mass, and even more preferably 0% by mass (i.e., free from any additional fluorescent agent), on the basis of the total mass of the composition.

Once the lubricating oil composition according to the embodiment comprises the above stilbene compound(s), even when blended with a phosphite ester, it is possible not only to prevent reduction in the thermal stability of the lubricating oil composition, but also to optionally improve the thermal stability of the lubricating oil composition.

In conventional cases, a stilbene compound is known to be incorporated as a fluorescent agent into refrigeration oil or the like (e.g., Patent Document 1: JP 2013-209590 A). Such refrigeration oil is mixed and diluted with a refrigerant at the time of use, and generally includes 0.1% by mass or more of a fluorescent agent to obtain a sufficient amount of fluorescence. In contrast, the amount of the fluorescent agent to be included in the lubricating oil composition for shock absorbers according to the embodiment is generally significantly lower than that used in refrigeration oil. Unlike refrigeration oil, no refrigerant (e.g., a fluorine-containing organic compound) is added or mixed into the lubricating oil composition for shock absorbers according to the embodiment, and ensures a sufficient amount of fluorescence even when comprising the fluorescent agent in a small amount. Moreover, as result of comprising a phosphite ester together with the stilbene compound as a fluorescent agent, the lubricating oil composition for shock absorbers according to the embodiment may surprisingly achieve the prevention of reduction in its thermal stability or the improvement of its thermal stability. In particular, the lubricating oil composition for shock absorbers according to the embodiment comprising a phosphite ester serving as an antiwear agent preferably comprises a mineral oil as a base oil, in terms of the solubility of additives including the phosphite ester. In this case, it is preferred that the fluorescent agent is used in a small amount (e.g., 0.1% by mass or less, more particularly less than 0.1% by mass), in terms of the solubility of the fluorescent agent.

[Component (C): Phosphite Ester]

In the lubricating oil composition according to the embodiment, a phosphite ester may serve as an antiwear agent. Accordingly, in the absence of such a phosphite ester compound, it is difficult to exert frictional wear properties which may fulfill the requirements. Such a phosphite ester is not limited in any way, but preferred is a phosphite ester having a hydrocarbon group containing 4 to 24 carbon atoms (preferably 6 to 20 carbon atoms, more preferably 8 to 18 carbon atoms), in terms of the solubility of additives.

For example, the phosphite ester is a compound represented by formula (3) shown below.

$$(R^1O)_aP(OH)_{3-n} \quad (3)$$

In the above formula (3), each $R^1$ independently represents a hydrocarbon group containing 4 to 24 carbon atoms (preferably 6 to 20 carbon atoms, more preferably 8 to 18 carbon atoms), and a represents an integer of 1 to 3. If a is 2 or 3, $R^1$ may be mutually identical or different.

Specific examples of a hydrocarbon group containing 4 to 24 carbon atoms include an alkyl group containing 4 to 24 carbon atoms, an alkenyl group containing 4 to 24 carbon atoms (which has a double bond at any position), an aryl group containing 6 to 24 carbon atoms, an aralkyl group containing 7 to 24 carbon atoms, etc. The above alkyl and alkenyl groups may be linear, branched or cyclic.

Examples of an alkyl group containing 4 to 24 carbon atoms include a n-butyl group, an isobutyl group, a sec-butyl group, a tert-butyl group, various pentyl groups, various hexyl groups, various heptyl groups, various octyl groups, various nonyl groups, various decyl groups, various undecyl groups, various dodecyl groups, various tridecyl groups, various tetradecyl groups, various pentadecyl groups, various hexadecyl groups, various heptadecyl groups, various octadecyl groups, various nonadecyl groups, various icosyl groups, various henicosyl groups, various docosyl groups, various tricosyl groups, various tetracosyl groups, a cyclopentyl group and a cyclohexyl group.

Examples of an alkenyl group containing 4 to 24 carbon atoms include various butenyl groups, various pentenyl groups, various hexenyl groups, various heptenyl groups, various octenyl groups, various nonenyl groups, various decenyl groups, various undecenyl groups, various dodecenyl groups, various tridecenyl groups, various tetradecenyl groups, various pentadecenyl groups, various hexadecenyl groups, various heptadecenyl groups, various octadecenyl groups, various nonadecynyl groups, various icocenyl groups, various henicosenyl groups, various docosenyl groups, various tricosenyl groups, various tetracosenyl groups, a cyclopentenyl group, a cyclohexenyl group and so on.

Examples of an aryl group containing 6 to 24 carbon atoms include a phenyl group, a tolyl group, a xylyl group, a naphthyl group and so on.

Examples of an aralkyl group containing 7 to 24 carbon atoms include a benzyl group, a phenethyl group, a naphthylmethyl group, a methylbenzyl group, a methylphenethyl group, a methylnaphthylmethyl group and so on.

Examples of such a phosphite ester include didecyl hydrogen phosphite, dilauryl hydrogen phosphite, dimyristyl hydrogen phosphite, dipalmityl hydrogen phosphite, distearyl hydrogen phosphite, tributyl phosphite, triphenyl phosphite, tricresyl phosphite, tri(nonylphenyl) phosphite, tri(2-ethylhexyl) phosphite, tridecyl phosphite, trilauryl phosphite, triisooctyl phosphite, diphenylisodecyl phosphite, tristearyl phosphite, trioleyl phosphite and so on.

Among them, preferred are those in which a is 2 and $R^1$ is an aliphatic hydrocarbon group containing 8 to 20 carbon atoms in the above formula (3), and more preferred are those in which a is 2 and $R^1$ is an aliphatic hydrocarbon group containing 10 to 18 carbon atoms, wherein the aliphatic hydrocarbon group is more preferably an alkyl group. Examples of such a phosphite ester include didecyl hydrogen phosphite, dilauryl hydrogen phosphite, dimyristyl hydrogen phosphite, dipalmityl hydrogen phosphite, distearyl hydrogen phosphite and so on, with dilauryl hydrogen phosphite being preferred in terms of high wear resistance.

The content of the phosphite ester is preferably 0.01% by mass or more, more preferably 0.02% by mass or more, and even more preferably 0.03% by mass or more, on the basis of the total mass of the composition, in terms of wear resistance. Alternatively, it is preferably 3% by mass or less, more preferably 2% by mass or less, and even more preferably 1% by mass or less, in terms of solubility. By way of example, the content of the phosphite ester is 0.01% to 3% by mass, or 0.02% to 2% by mass, or 0.03% to 1% by mass.

[Component (D): Other Additives]

The lubricating oil composition may optionally comprise other components (D) including an ash-free detergent dispersant, a metal-based detergent, a lubricity improver, an antioxidant, an anticorrosive, a metal deactivator, a viscosity index improver, a pour point depressant and a defoaming agent, as long as the effect of the present invention is not impaired.

(Ash-Free Detergent Dispersant)

Examples of an ash-free detergent dispersant include succinimides, boron-containing succinimides, benzylamines, boron-containing benzylamines, succinic acid esters, monovalent or divalent carboxylic acid amides typified by fatty acids or succinic acid, etc. These may be used alone, or two or more of them may be used in combination. The content of the ash-free detergent dispersant(s) is not limited in any way, but it is preferably 0.1% to 20% by mass on the basis of the total mass of the composition.

(Metal-Based Detergent)

Examples of a metal-based detergent include organometallic compounds containing a metal atom selected from alkali metal atoms and alkaline earth metal atoms (preferably containing an alkaline earth metal atom), as specifically exemplified by metal salicylates, metal phenates and metal sulfonates, etc. In terms of improved cleanliness at high temperatures, the metal atom is preferably a sodium atom, a calcium atom, a magnesium atom or a barium atom, more preferably a calcium atom or a magnesium atom, and even more preferably a calcium atom. These metal-based detergents may be used alone, or two or more of them may be used in combination.

Preferred for use is a basic or perbasic metal-based detergent, and its base number is preferably 10 to 500 mg KOH/g. Moreover, its base number is more preferably 200 mg to 500 mg KOH/g, and even more preferably 250 to 450 mg KOH/g. The base number (hydrochloric acid method) is measured by potentiometric titration (base number, hydrochloric acid method) according to JIS K2501:2003.

The amount of metal atoms from the metal-based detergent(s) is preferably 10 to 1500 ppm by mass, more preferably 150 to 1000 ppm by mass, and even more preferably 250 to 750 ppm by mass, on the basis of the total mass of the composition.

(Lubricity Improver)

The lubricity improver to be used may be selected as appropriate from among known lubricity improvers conventionally used as lubricity improvers for lubricating oil. Specific examples include an organometallic compound, an oiliness improver, an extreme pressure agent, etc.

Examples of an organometallic compound include zinc dithiophosphate (ZnDTP), zinc dithiocarbamate (ZnDTC), sulfurized oxymolybdenum organophosphorodithioate (MoDTP), sulfurized oxymolybdenum dithiocarbamate (MoDTC) and so on. The content of such an organometallic compound is generally 0.05% to 5% by mass on the basis of the total mass of the composition.

Examples of an oiliness improver include aliphatic saturated and unsaturated monocarboxylic acids (e.g., stearic acid, oleic acid), polymeric fatty acids (e.g., dimer acid, hydrogenated dimer acid), hydroxyfatty acids (e.g., ricinoleic acid, 12-hydroxystearic acid), aliphatic saturated and unsaturated monoalcohols (e.g., lauryl alcohol, oleyl alcohol), aliphatic saturated and unsaturated monoamines (e.g., stearyl amine, oleyl amine), aliphatic saturated and unsaturated monocarboxylic acid amides (e.g., lauric acid amide, oleic acid amide, isostearic acid amide) and so on. The content of such an oiliness improver is preferably 0.01% to 10% by mass on the basis of the total mass of the composition.

Examples of an extreme pressure agent include sulfur-based compounds (e.g., sulfurized olefins, dialkyl polysulfides, diarylalkyl polysulfides, diaryl polysulfides), phosphorus-based compounds except for phosphite esters (e.g., phosphate esters (e.g., tricresyl phosphate (TCP)), thiophosphate esters, phosphate ester amine salts, phosphite ester amine salts) and so on. These may be used alone, or two or more of them may be used in combination. The content of such an extreme pressure agent is not limited in any way, but it is preferably 0.01% to 10% by mass on the basis of the total mass of the composition.

(Antioxidant)

The antioxidant to be used may be selected as appropriate from among known antioxidants conventionally used as antioxidants for lubricating oil. Examples include an amine-based antioxidant, a phenol-based antioxidant, a molybdenum-based antioxidant, a sulfur-based antioxidant, a phosphorus-based antioxidant, etc.

Examples of an amine-based antioxidant include diphenylamine-based antioxidants (e.g., diphenylamine, alkylated diphenylamine having an alkyl group containing 3 to 20 carbon atoms), naphthylamine-based antioxidants (e.g., α-naphthylamine, $C_3$-$C_{20}$ alkyl-substituted phenyl-α-naphthylamine) and so on.

Examples of a phenol-based antioxidant include monophenol-based antioxidants (e.g., 2,6-di-tert-butyl-p-cresol (DBPC), 2,6-di-tert-butyl-4-ethylphenol, octadecyl-3-(3,5-di-tert-butyl-4-hydroxyphenyl)propionate), diphenol-based antioxidants (e.g., 4,4'-methylenebis(2,6-di-tert-butylphenol), 2,2'-methylenebis(4-ethyl-6-tert-butylphenol)), hindered phenol-based antioxidants and so on.

Examples of a molybdenum-based antioxidant include a molybdenum-amine complex prepared by reacting molybdenum trioxide and/or molybdic acid with an amine compound, and so on.

Examples of a sulfur-based antioxidant include dilauryl-3,3'-thiodipropionate and so on.

Examples of a phosphorus-based antioxidant include phosphites and so on.

These antioxidants may be used alone, or two or more of them may be used in combination. In general, two or more of them are preferably used in combination. The content of the antioxidant(s) is not limited in any way, but it is preferably 0.01% to 10% by mass on the basis of the total mass of the composition.

(Anticorrosive)

Examples of an anticorrosive available for use include alkyl or alkenyl succinic acid derivatives (e.g., dodecenyl succinic acid half ester, octadecenyl succinic acid anhydride, dodecenyl succinic acid amide), partial esters of polyhydric alcohols (e.g., sorbitan monooleate, glycerin monooleate, pentaerythritol monooleate), amines (e.g., rosin amine, N-oleylsarcosine), dialkyl phosphite amine salts, etc. These may be used alone, or two or more of them may be used in combination. The content of the anticorrosive(s) is not limited in any way, but it is preferably 0.01% to 5.0% by mass on the basis of the total mass of the composition.

(Metal Deactivator)

Examples of a metal deactivator include benzotriazole, triazole derivatives, benzotriazole derivatives, thiadiazole derivatives, etc. These metal deactivators may be used alone, or two or more of them may be used in combination. The content of the metal deactivator(s) is not limited in any way, but it is preferably 0.01% to 3.0% by mass on the basis of the total mass of the composition.

(Viscosity Index Improver)

Examples of a viscosity index improver include polymethacrylates, dispersed polymethacrylates, olefin-based copolymers (e.g., ethylene-propylene copolymers), dispersed olefin-based copolymers, styrene-based copolymers (e.g., hydrogenated styrene-diene copolymers), etc. The content of the viscosity index improver is not limited in any way, but it is preferably about 0.5% to 35% by mass on the basis of the total mass of the composition. Moreover, the weight average molecular weight (Mw) is preferably 1,000 to 1,500,000, more preferably 20,000 to 1,000,000, and even more preferably 100,000 to 800,000, in terms of achieving the optimum kinematic viscosity and viscosity index of the lubricating oil composition. It should be noted that the weight average molecular weight (Mw) may be measured by gel permeation chromatography (calculated as standard polystyrene).

(Pour Point Depressant)

Examples of a pour point depressant include ethylene-vinyl acetate copolymers, a condensate of chlorinated paraffin and naphthalene, a condensate of chlorinated paraffin and phenol, polymethacrylates, polyalkylstyrenes, etc., with polymethacrylates being particularly preferred for use. These pour point depressants may be used alone, or two or more of them may be used in combination. The content of the pour point depressant(s) is not limited in any way, but it is preferably 0.01% to 5.0% by mass on the basis of the total mass of the composition.

(Defoaming Agent)

Examples of a defoaming agent include dimethylpolysiloxane, polyacrylates, etc. These defoaming agents may be used alone, or two or more of them may be used in combination. The content of the defoaming agent(s) is not limited in any way, but it is preferably 0.0002% to 0.15% by mass on the basis of the total mass of the composition.

[Features of the Lubricating Oil Composition for Shock Absorbers]

The lubricating oil composition for shock absorbers according to the embodiment is capable of emitting fluorescence upon ultraviolet irradiation. Thus, when a shock absorber is irradiated with ultraviolet light to confirm the presence or absence of fluorescence, it is possible to detect whether or not the lubricating oil composition for shock absorbers is leaking from the shock absorber. The composition according to the embodiment allows easy discrimination of whether the composition filled into the shock absorber is leaking to the outside or another oil component different from the lubricating oil composition for shock absorbers is merely adhered to the shock absorber due to any other external factor.

The lubricating oil composition for shock absorbers according to the embodiment is resistant to deterioration due to oxidation at high temperatures and is excellent in thermal stability. This allows the reduction or prevention of sludge generation at high temperatures. Thus, one embodiment is directed to a method for improving the thermal stability of the above lubricating oil composition, which comprises incorporating the component (A), the component (B) and the component (C). In addition, the lubricating oil composition for shock absorbers according to the embodiment is excellent in wear resistance (particularly wear resistance between metal members), so that the durability of shock absorbers is improved. Thus, another embodiment is directed to a method for improving the wear resistance of the above lubricating oil composition, which comprises incorporating the component (A), the component (B) and the component (C).

[Applications of the Lubricating Oil Composition]

The lubricating oil composition for shock absorbers according to the embodiment can be used as a lubricating oil for shock absorbers and, when filled into a shock absorber, serves as a lubricating oil for lubrication between individual parts of the shock absorber. Namely, in yet another embodiment of the present invention, there is provided a shock absorber containing the above lubricating oil composition for shock absorbers. For example, the lubricating oil composition according to the embodiment is used for lubrication in the members of a car body shock absorber for two-wheeled and four-wheeled vehicles, etc. (particularly used for lubrication in the sliding part of an oil seal/piston rod, etc.). In more detail, the lubricating oil composition can be used in both twin-tube and mono-tube shock absorbers, and also can be used in shock absorbers for either four-wheeled or two-wheeled vehicles, but may be particularly preferred for use in shock absorbers for four-wheeled vehicles.

[Method for Reducing Friction in Shock Absorbers]

In yet another embodiment of the present invention, there is provided a method for reducing friction in shock absorbers. In more detail, this method is characterized in that the lubricating oil composition for shock absorbers according to the embodiment is added to shock absorbers.

The above method for reducing friction may be effective for all types of shock absorbers. For example, this method is capable of reducing friction in both twin-tube and mono-tube shock absorbers. Moreover, this method is capable of reducing friction in shock absorbers for either four-wheeled or two-wheeled vehicles, but is particularly excellent in the effect of reducing friction in shock absorbers for four-wheeled vehicles.

[Process for Preparing the Lubricating Oil Composition]

The lubricating oil composition according to the embodiment may be prepared in any manner. In one embodiment, a process for preparing the lubricating oil composition comprises mixing the component (A), the component (B) and the component (C). The component (A), the component (B) and the component (C), and optionally the component (D) may be mixed in any manner, and the order of mixing and techniques required therefor are not limited in any way.

EXAMPLES

The present invention will be further described in more detail by reference to the illustrative examples given below, although the technical scope of the present invention is not limited thereto.

The materials used in the inventive examples and comparative examples given below, as well as the physical properties measured for each of the lubricating oil compositions prepared in these inventive and comparative examples were obtained in the way shown below.

(1) Kinematic Viscosity

According to JIS K2283:2000, the kinematic viscosity at 40° C. (40° C. kinematic viscosity) and the kinematic viscosity at 100° C. (100° C. kinematic viscosity) were measured with a glass capillary viscometer.

(2) Density

The density was measured according to JIS K2249-4: 2011.

(3) Mass Average Molecular Weight (Mw)

The mass average molecular weight was measured with a gel permeation chromatographic device (Agilent, "Model 1260 HPLC") under the conditions shown below, and the measured values calculated as standard polystyrene were used.

(Measurement Conditions)

Column: Two "Shodex LF404" columns connected in sequence

Column temperature: 35° C.

Developing solvent: chloroform

Flow rate: 0.3 mL/min

INVENTIVE EXAMPLES 1 TO 6 AND COMPARATIVE EXAMPLES 1 TO 4

As shown in Table 1 below, a base oil was blended with the individual components indicated in Table 1 below to prepare lubricating oil compositions of the inventive and comparative examples, each containing the base oil and these individual components.

It should be noted that the details of fluorescent agents A and B, each being used as a fluorescent agent, are as shown below.

[Formula 2]

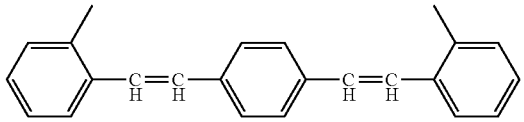

Fluorescent agent A: p-Bis(o-methylstyrylbenzene)

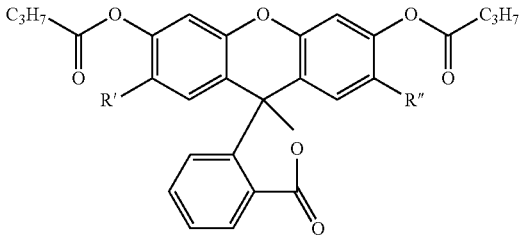

Fluorescent agent B: Dialkylfluorescein dibutyrate

In addition, a phenol-based antioxidant (2,6-di-tert-butyl-p-cresol (DBPC)), an oiliness improver (isostearic acid amide), an extreme pressure agent (a phosphate ester (tricresyl phosphate (TCP)), an oiliness improver (oleic acid) and an anticorrosive (sorbitan monooleate) were used as other additives.

Table 1 below shows the composition of the lubricating oil compositions of the inventive and comparative examples.

The following tests were performed on the lubricating oil compositions prepared in the inventive and comparative examples. The results obtained are shown in Table 1.

1. Ultraviolet Irradiation Test

The lubricating oil compositions prepared in the inventive and comparative examples were irradiated in the dark with ultraviolet light (wavelength: 280 nm) for 10 seconds to confirm the presence or absence of fluorescence, followed by evaluation on the basis of the criteria shown below.

○: Fluorescence emission was observed.

x: No fluorescence emission was observed.

2. Thermal Stability Test

Into 200 mL beakers, 100 mL of the lubricating oil compositions prepared in the inventive and comparative examples were introduced respectively together with a steel member (a 1 cm wide piece cut from the inner tube of a shock absorber; material: steel). The beakers were allowed to stand in a thermostat at 140° C. for 96 hours and then confirmed for the presence or absence of sludge on their bottom surface, followed by evaluation on the basis of the criteria shown below. A smaller amount of sludge indicates higher thermal stability.

◎: No sludge was confirmed.

○: A small amount of sludge was confirmed.

x: A large amount of sludge was confirmed.

3. Wear Resistance Test

Each sample was tested with a Bowden-type reciprocating friction tester under the test conditions shown below, and the width of wear mark on the lower test piece was then measured under an optical microscope. A smaller wear mark width indicates higher lubricity and higher wear resistance.

(Steel Wear Test Conditions)

Oil temperature: 100° C.

Amplitude: 10 mm

Load: 3 kgf

Rate: 50 mm/s

Test time: 30 minutes

Friction material

Upper test piece: ½-inch SUJ-2 ball (high carbon chromium bearing steel)

Lower test piece: SPCC-SB plate (cold-rolled steel plate with mirror-finished surface)

confirmed that the lubricating oil compositions of Inventive Examples 1 to 5 containing 0.02% by mass or more of the hydrocarbon compound having a stilbene structure showed no sludge in the thermal stability test and are particularly excellent in thermal stability. Comparative Example 2 containing no fluorescent agent showed a small amount of sludge generation, thus suggesting that as a result of containing a certain amount of a hydrocarbon compound having a stilbene structure as a fluorescent agent, lubricating oil compositions not only prevent reduction in their thermal stability but also achieve improvement in their thermal stability.

Likewise, the lubricating oil compositions of the inventive examples containing both a phosphite ester and a hydrocarbon compound having a stilbene structure were

TABLE 1

| Lubricating oil composition | | | Inv. Ex 1 | Inv. Ex 2 | Inv. Ex 3 | Inv. Ex 4 | Inv. Ex 5 | Inv. Ex 6 | Com. Ex 1 | Com. Ex 2 | Com. Ex 3 | Com. Ex 4 |
|---|---|---|---|---|---|---|---|---|---|---|---|---|
| Composition (% by mass) | Base oil | Mineral oil A<br>40° C. kinematic viscosity: 3.59 $mm^2/s$<br>100° C. kinematic viscosity: 1.36 $mm^2/s$<br>Density (15° C.): 0.846 $g/cm^3$ | 15.00 | 15.00 | 15.00 | 15.00 | 15.00 | 15.00 | 15.00 | 15.00 | 15.00 | 15.00 |
| | | Mineral oil B<br>40° C. kinematic viscosity: 9.91 $mm^2/s$<br>100° C. kinematic viscosity: 2.56 $mm^2/s$<br>Density (15° C.): 0.847 $g/cm^3$ | 43.40 | 43.42 | 43.45 | 43.47 | 43.48 | 43.49 | 43.40 | 43.50 | 43.90 | 43.50 |
| | | Mineral oil C<br>40° C. kinematic viscosity = 9.28 $mm^2/s$<br>100° C. kinematic viscosity = 2.33 $mm^2/s$<br>Density (15° C.) = 0.891 $g/cm^3$ | 35.00 | 35.00 | 35.00 | 35.00 | 35.00 | 35.00 | 35.00 | 35.00 | 35.00 | 35.00 |
| | Phosphite ester | Dilauryl hydrogen phosphite | 0.50 | 0.50 | 0.50 | 0.50 | 0.50 | 0.50 | 0.50 | 0.50 | | 0.50 |
| | Fluorescent agent | Fluorescent agent A<br>p-Bis(o-methylstyrylbenzene) | 0.10 | 0.08 | 0.05 | 0.03 | 0.02 | 0.01 | | | | |
| | | Fluorescent agent B<br>Dialkylfluorescein dibutyrate | | | | | | | 0.10 | | 0.10 | 0.005 |
| | Others | Viscosity index improver<br>Polymethacrylate<br>Mass average molecular weight (Mw): 140,000 | 4.30 | 4.30 | 4.30 | 4.30 | 4.30 | 4.30 | 4.30 | 4.30 | 4.30 | 4.30 |
| | | Other additives | 1.70 | 1.70 | 1.70 | 1.70 | 1.70 | 1.70 | 1.70 | 1.70 | 1.70 | 1.70 |
| | | Total | 100.00 | 100.00 | 100.00 | 100.00 | 100.00 | 100.00 | 100.00 | 100.00 | 100.00 | 100.00 |
| Properties of composition | | 40° C. kinematic viscosity ($mm^2/s$) | 8.0 | 8.0 | 8.0 | 8.0 | 8.0 | 8.0 | 8.0 | 8.0 | 8.0 | 8.0 |
| | | 100° C. kinematic viscosity ($mm^2/s$) | 2.2 | 2.2 | 2.2 | 2.2 | 2.2 | 2.2 | 2.2 | 2.2 | 2.2 | 2.2 |
| Performance evaluation | | Ultraviolet irradiation test | ○ | ○ | ○ | ○ | ○ | ○ | ○ | X | ○ | ○ |
| | | Thermal stability test | ◎ | ◎ | ◎ | ◎ | ◎ | ○ | X | ○ | ◎ | X |
| | | Wear resistance test (wear mark width, mm) | 0.78 | 0.77 | 0.79 | 0.77 | 0.76 | 0.78 | 0.78 | 0.79 | 1.18 | 0.77 |

As shown in Table 1, it was confirmed that the lubricating oil compositions of the inventive examples containing not only a phosphite ester but also a hydrocarbon compound having a stilbene structure as a fluorescent agent are excellent in thermal stability and wear resistance. In more detail, the lubricating oil compositions of the inventive examples containing the fluorescent agent A, which is a hydrocarbon compound having a stilbene structure, were able to prevent or reduce sludge generation in the thermal stability test and were excellent in thermal stability. In particular, it was excellent in wear resistance, because the width of wear mark observed in the wear resistance test was small in each inventive example.

On the other hand, Comparative Example 1 containing the fluorescent agent B (dialkylfluorescein dibutyrate), which is a conventional typical fluorescent agent, and a phosphite ester showed a large amount of sludge generation in the thermal stability test, so that the thermal stability was reduced. Even when reducing the amount of the conventional fluorescent agent (Comparative Example 4), the reduction in thermal stability was not able to be prevented.

Comparative Example 2 containing a phosphite ester and no fluorescent agent showed good thermal stability and good wear resistance, but light emission upon ultraviolet irradiation was not confirmed. Except for Comparative Example 2, the lubricating oil compositions were all confirmed to emit fluorescence at easily detectable levels upon ultraviolet irradiation.

Comparative Example 3 containing no phosphite ester and containing the fluorescent agent B showed good thermal stability, but its wear resistance was not sufficient because the width of wear mark observed in the wear resistance test was large.

INDUSTRIAL APPLICABILITY

The lubricating oil composition for shock absorbers according to the present invention comprises a phosphite ester and a hydrocarbon compound having a stilbene structure in combination in a base oil, and is capable of light emission upon ultraviolet irradiation, and is also excellent in thermal stability and wear resistance. For this reason, the lubricating oil composition not only allows easy detection of oil leakage from automobile shock absorbers, but also allows increases in the thermal stability and wear resistance of the lubricating oil composition, and improvements in the durability of shock absorbers and the riding comfort of automobiles.

The invention claimed is:

1. A lubricating oil composition for shock absorbers, the lubricating oil composition comprising:

(A) a base oil;

(B) a hydrocarbon compound selected from the group of compounds of formula (1) and formula (2); and (C) a phosphite ester;

(1)

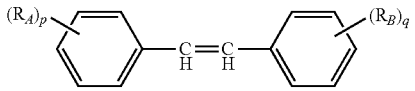

(2)

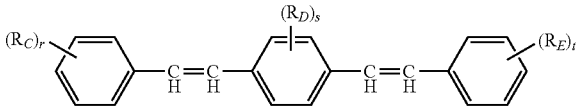

wherein $R_A$ to $R_E$ each independently represent a hydrocarbon group containing 1 to 18 carbon atoms, an alkenyl group containing 2 to 18 carbon atoms, an aryl group containing 6 to 18 carbon atoms an aralkyl group containing 7 to 18 carbon atoms, p, q, r and t are each independently an integer of 1 to 5, s is an integer of 0 to 4, $R_A$ to $R_E$ may be mutually identical or different, and wherein a content of the component (B) is from 0.001% by mass to 0.1% by mass, on the basis of the total mass of the composition, and wherein when 100 mL of the lubricating oil composition is placed in a beaker and exposed to a 1 cm wide steel piece cut from the inner tube of a shock absorber and allowed to stand in a thermostat at 140° C. for 96 hours no sludge is formed on the bottom surface of the beaker, and when tested with a Bowden-type reciprocating friction tester the width of a wear mark on the lower test piece measured under an optical microscope is 0.79 mm or less.

2. The composition according to claim 1, wherein the component (A) contains a mineral oil as a major component.

3. The composition according to claim 1, the component (B) comprises p-bis(o-methylstyryl)benzene.

4. The composition according to claim 1, wherein the content of the component (C) is from 0.01% by mass to 3% by mass, on the basis of the total mass of the composition.

5. The composition according to claim 1, wherein the component (C) has a hydrocarbon group containing 4 to 24 carbon atoms.

6. The composition according to claim 1, further comprising:

at least one selected from the group consisting of an ash-free detergent dispersant, a metal-based detergent, a lubricity improver, an antioxidant, an anticorrosive, a metal deactivator, a viscosity index improver, a pour point depressant and a defoaming agent.

7. A shock absorber for a four-wheeled vehicle, comprising the composition according to claim 1, as a lubricating oil composition.

8. A process for preparing the composition of claim 1, the process comprising mixing the component (A), the component (B) and the component (C).

* * * * *